US005459648A

United States Patent [19]

Courtney

[11] Patent Number: 5,459,648

[45] Date of Patent: Oct. 17, 1995

[54] ILLUMINATED UTILITY BOX

[76] Inventor: Glenn H. Courtney, 418 Arbor Rd., Yeadon, Pa. 19050

[21] Appl. No.: 299,948

[22] Filed: Sep. 2, 1994

[51] Int. Cl.[6] ..... A45C 15/06; F01V 33/00

[52] U.S. Cl. ..... 362/154; 362/155; 362/234; 362/287; 362/427; 206/373

[58] Field of Search ..... 362/154, 155, 362/183, 189, 191, 234, 236, 242, 269, 287, 288, 427; 43/54.1, 57.1, 17.5; 206/373; 312/902

[56] References Cited

U.S. PATENT DOCUMENTS

| | | | |
|---|---|---|---|
| 2,230,458 | 2/1941 | Hummert | 362/183 |
| 3,134,383 | 5/1964 | Thompson | 362/155 |
| 4,691,470 | 9/1987 | Landell et al. | 362/191 |
| 4,692,850 | 9/1987 | Ledoux | 362/427 |
| 4,754,376 | 6/1988 | Winslow | 362/191 |
| 4,855,881 | 9/1989 | Pence | 362/191 |

FOREIGN PATENT DOCUMENTS

| | | | |
|---|---|---|---|
| 186663 | 12/1936 | Switzerland | 362/427 |
| 1044119 | 9/1966 | United Kingdom | 362/155 |

*Primary Examiner*—Ira S. Lazarus
*Assistant Examiner*—Y. Quach

[57] ABSTRACT

A utility box for containing and illuminating objects present therein. The inventive device includes a main body having a lid pivotally mounted thereto. A compartmented tray is mounted to the lid and remains horizontal during movement of the lid. A lid light is movably mounted to an interior of the lid for illuminating both an interior and exterior of the box. The device may further include compartment lights for illuminating each compartment of the tray, and a main body light for illuminating the interior of the main body. Further, a telescoping light may be mounted to the interior of the main body and extended therefrom to further illuminate the area around the box.

1 Claim, 5 Drawing Sheets

ILLUMINATED UTILITY BOX

BACKGROUND OF THE INVENTION

1. Field of the Invention

The present invention relates to storage devices and more particularly pertains to an illuminated utility box for containing and illuminating objects present therein.

2. Description of the Prior Art

The use of storage devices is known in the prior art. More specifically, storage devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art storage devices include U.S. Pat. Nos. 5,143,440; 3,231,730; 5,071,004; 3,294,968; 5,088,014; and 5,219,446.

While these devices fulfill their respective, particular objectives and requirements, the aforementioned patents do not disclose a utility box for containing and illuminating objects present therein which includes a main body having a lid pivotally mounted thereto, a compartmented tray mounted to the lid, and a lid light movably mounted to the interior of the lid for illuminating both interior and exterior of the box. Furthermore, none of the known prior art storage devices teach or suggest an apparatus of the aforementioned structure which further includes compartment lights for illuminating each compartment of the tray, a main body light for illuminating the interior of the main body, and a telescoping light mounted to the interior of the main body and extendable therefrom to further illuminate the area around the box.

In these respects, the illuminated utility box according to the present invention substantially departs from the conventional concepts and designs of the prior art, and in so doing provides an apparatus primarily developed for the purpose of containing and illuminating objects present therein.

SUMMARY OF THE INVENTION

In view of the foregoing disadvantages inherent in the known types of storage devices now present in the prior art, the present invention provides a new illuminated utility box construction wherein the same can be utilized for containing and illuminating objects present therein. As such, the general purpose of the present invention, which will be described subsequently in greater detail, is to provide a new illuminated utility box apparatus and method which has many of the advantages of the storage devices mentioned heretofore and many novel features that result in a illuminated utility box which is not anticipated, rendered obvious, suggested, or even implied by any of the prior art storage devices, either alone or in any combination thereof.

To attain this, the present invention generally comprises a utility box for containing and illuminating objects present therein. The inventive device includes a main body having a lid pivotally mounted thereto. A compartmented tray is mounted to the lid and remains horizontal during movement of the lid. A lid light is movably mounted to an interior of the lid for illuminating both interior and exterior of the box. The device may further include compartment lights for illuminating each compartment of the tray, and a main body light for illuminating the interior of the main body. Further, a telescoping light may be mounted to the interior of the main body and extended therefrom to further illuminate the area around the box.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the .nature and essence of the technical disclosure of the application. The abstract is neither intended to define the invention of the application, which is measured by the claims, nor is it intended to be limiting as to the scope of the invention in any way.

It is therefore an object of the present invention to provide a new illuminated utility box apparatus and method which has many of the advantages of the storage devices mentioned heretofore and many novel features that result in a illuminated utility box which is not anticipated, rendered obvious, suggested, or even implied by any of the prior art storage devices, either alone or in any combination thereof.

It is another object of the present invention to provide a new illuminated utility box which may be easily and efficiently manufactured and marketed.

It is a further object of the present invention to provide a new illuminated utility box which is of a durable and reliable construction.

An even further object of the present invention is to provide a new illuminated utility box which is susceptible of a low cost of manufacture with regard to both materials and labor, and which accordingly is then susceptible of low prices of sale to the consuming public, thereby making such illuminated utility boxes economically available to the buying public.

Still yet another object of the present invention is to provide a new illuminated utility box which provides in the apparatuses and methods of the prior art some of the advantages thereof, while simultaneously overcoming some of the disadvantages normally associated therewith.

Still another object of the present invention is to provide a new illuminated utility box for containing and illuminating objects present therein.

Yet another object of the present invention is to provide a new illuminated utility box which includes a main body having a lid pivotally mounted thereto, a compartmented tray mounted to the lid, and a lid light movably mounted to the interior of the lid for illuminating both interior and exterior of the box.

Even still another object of the present invention is to provide a new illuminated utility box of the aforementioned structure which further includes compartment lights for illuminating each compartment of the tray, and a main body light for illuminating the interior of the main body.

Even still yet another object of the present invention provide a new illuminated utility box which additionally includes a telescoping light mounted to the interior of the main body and extendable therefrom to further illuminate the area around the box.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
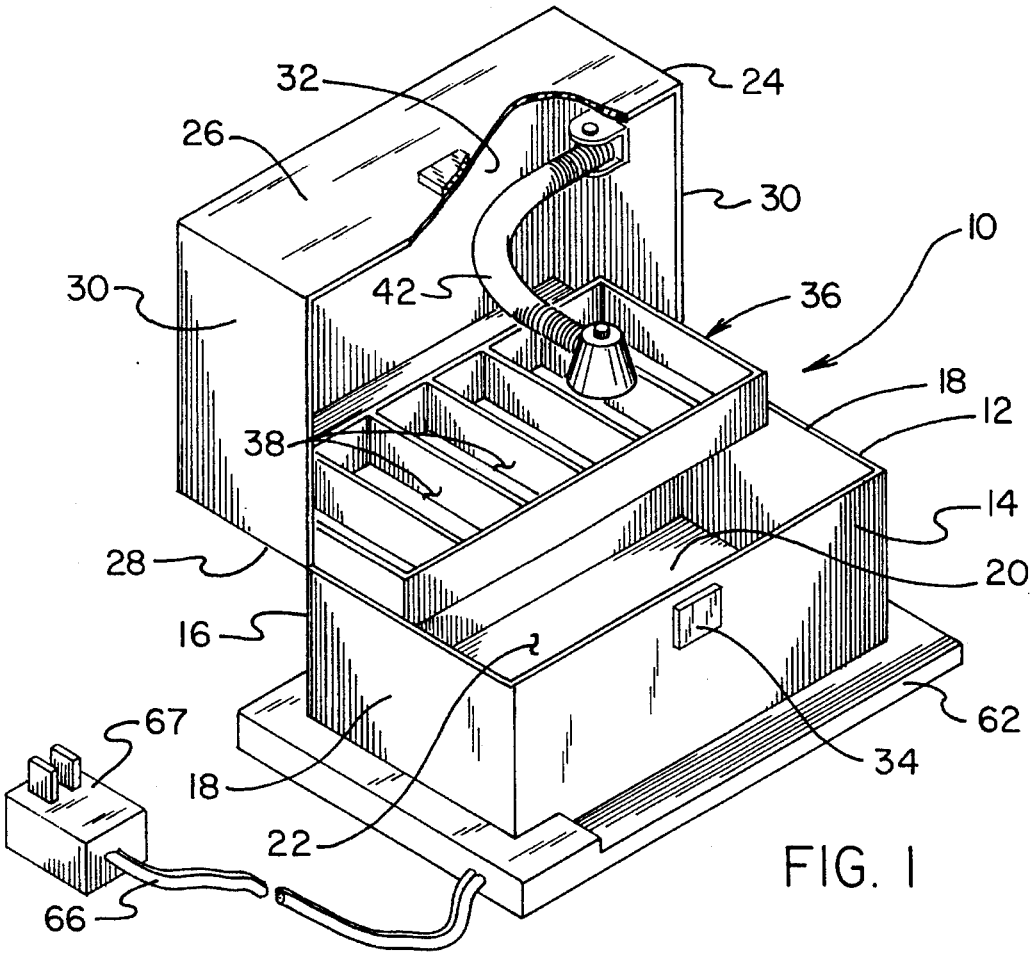
FIG. 1 is an isometric illustration of the illuminated utility box according to the present invention.

With reference now to the drawings, and in particular to FIGS. 1–12 thereof, a new illuminated utility box embodying the principles and concepts of the present invention and generally designated by the reference numeral 10 will be described.

More specifically, it will be noted that the illuminated utility box 10 comprises a main body 12 having a front wall 14 spaced from a rear wall 16, and a pair of opposed sidewalls 18 which project orthogonally from a bottom wall 20 to define a main body interior 22. A lid 24 includes a lid front wall 26 spaced from a lid rear wall 28 and a pair of opposed lid sidewalls 30 which project from a lid top wall 32. The lid 24 is pivotally mounted at the lid rear wall 28 to the rear wall 16 of the main body 12. Thus, the lid 24 may be pivotally positioned into abutting relationship relative to the main body 12 so as to enclosed the main body interior 22. Further, a lid latch 34 is provided and operable to retain the lid 24 in such a closed position.

Figure 2:
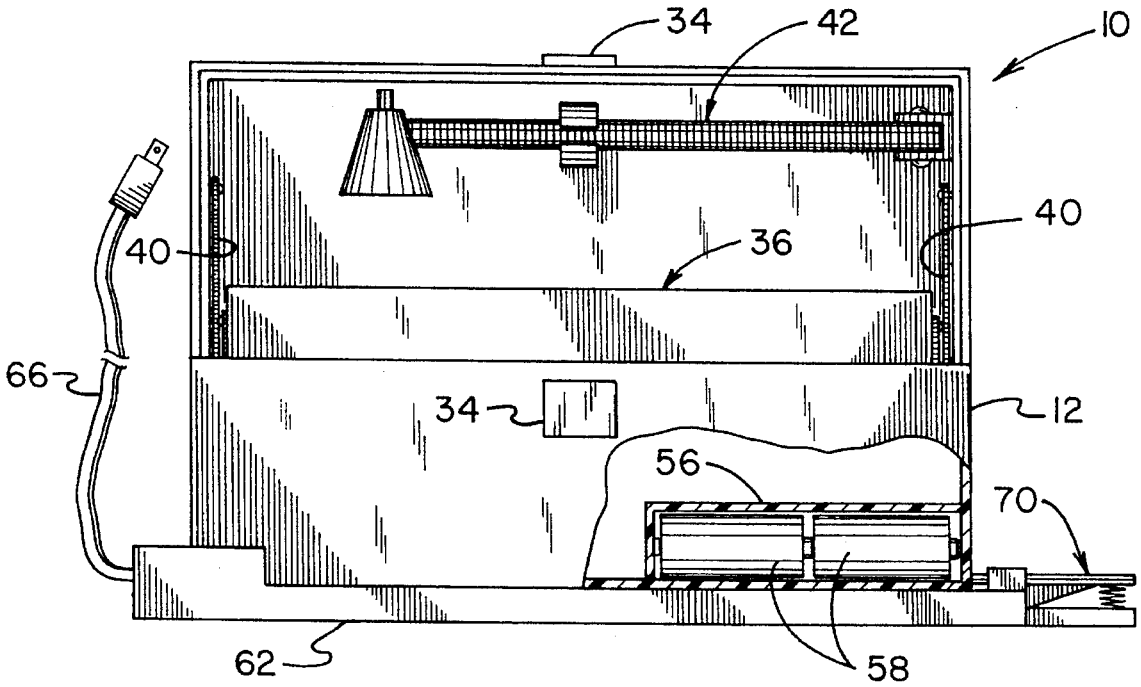
FIG. 2 is a front elevation view thereof.

As best illustrated in FIGS. 1 and 2 of the drawings, a tray 36 having a plurality of compartments 38 is pivotally mounted to the lid 24 by a plurality of levers 40 which cooperate to maintain the tray 36 in a substantially horizontal position during opening and closing of the lid 24 relative to the main body 12. By this structure, the tray 36 is not only maintained in a horizontal position, but is also moved relative to the main body 12 during opening of the lid 24 so as to permit access into the main body interior 22, as shown in FIG. 1.

Figure 5:
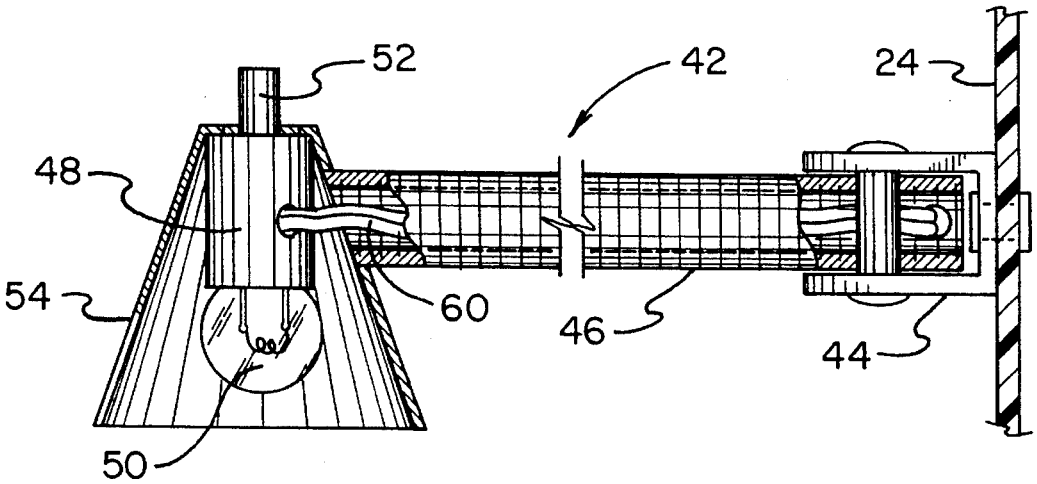
FIG. 5 is a front elevation view of a lid light comprising a portion of the present invention.

With continuing reference to FIGS. 1 and 2, it can be shown that the device 10 further comprises a lid light 42 which is pivotally mounted to an interior of the lid 24, and preferably pivotally mounted to an interior of one of the sidewalls 30 of the lid 24. As best illustrated in FIG. 5, the lid light 42 comprises a bracket 44 which enables the light 42 to be pivotally mounted to the sidewall 30 of the lid 24 by an unlabeled pivot pin. A length of flexible tubing 46 is pivotally mounted to the bracket 44 and may be bent into either straight or curved shapes. A bulb receptacle 48 is mounted via wires 60 to an outer distal end of the flexible tubing 46 and is operable to receive and mount a light bulb 50. A switch 52 is coupled to the bulb receptacle 48 and is operable to effect selective energization of the light bulb 50. A shade 54 extends around the bulb receptacle 48 and is preferably formed in the shape of a truncated cone.

Referring now to FIG. 2, it can be shown that the main body 12 further includes a battery compartment 56 operable to contain a plurality of batteries 58. The batteries 58 are preferably of the rechargeable type such as nickel-cadmium or the like. Regardless of the type of battery 58 utilized within the device 10, the batteries communicate with the light bulb 50 via a plurality of wires 60.

Figure 3:
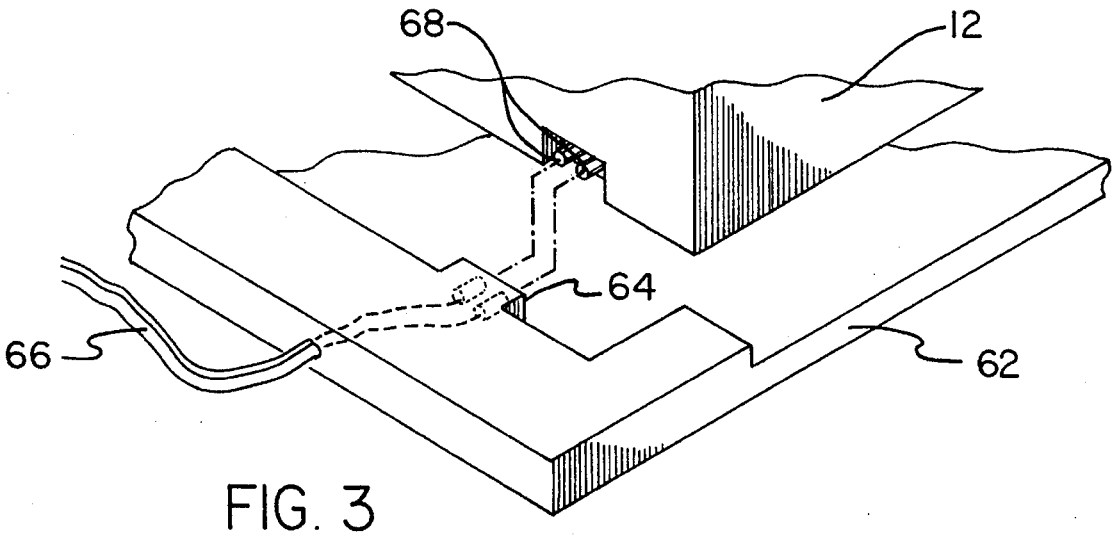
FIG. 3 is an enlarged isometric illustration of a portion of the invention.
Figure 4:
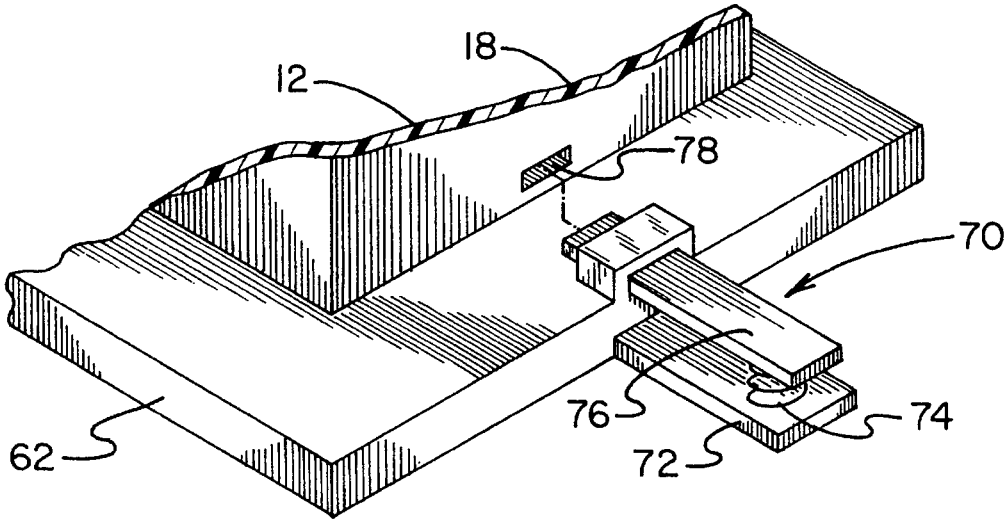
FIG. 4 is a further enlarged isometric illustration of a further portion of the invention.

To effect recharging of the batteries 58, a charging base 62 is also provided. As best illustrated in FIGS. 3 and 4 of the drawings, the charging base 62 includes a receptacle 64 which communicates with an external power source, such as a standard electrical outlet, through a power cord 66. The receptacle 64 is operable to engage and electrically communicate with a pair of contacts 68 extending from one of the sidewalls of the main body 12. The contacts 68 are an electrical communication with the batteries 58 through an appropriate charging circuit known in the art to include transformers, diodes, rectifiers, and the like which supply DC current to the batteries at an appropriate voltage for charging. Alternatively, the charging base 62 can include a power cord 66 having an external charging transformer 67, as shown in FIG. 1, which includes the charging circuitry for supplying DC current to the batteries at the appropriate voltage for charging. Thus, the power cord means of the present invention may comprise either the power cord illustrated in FIG. 2 having a standard plug receptacle, or alternatively, a power cord having the external charging transformer 67 coupled directly to the plug thereof so as to reduce the weight of the charging base 62.

To retain the main body 12 relative to the charging base 62 during the charging procedure, a latch means 70 is provided. The latch means 70 preferably comprises a lever mount 72 which projects from the charging base 62 and supports a coil spring 74 in a substantially vertical orientation. A lever 76 is movably mounted relative to the charging base 62 and supported relative to the lever mount 72 by the coil spring 74. A lever 76 is operable to be positioned within a cavity 78 formed in another one of these sidewalls 18 of the main body 12. By this structure, the main body 12 is removably coupled to the charging base 62 during the charging procedure.

Figure 6:
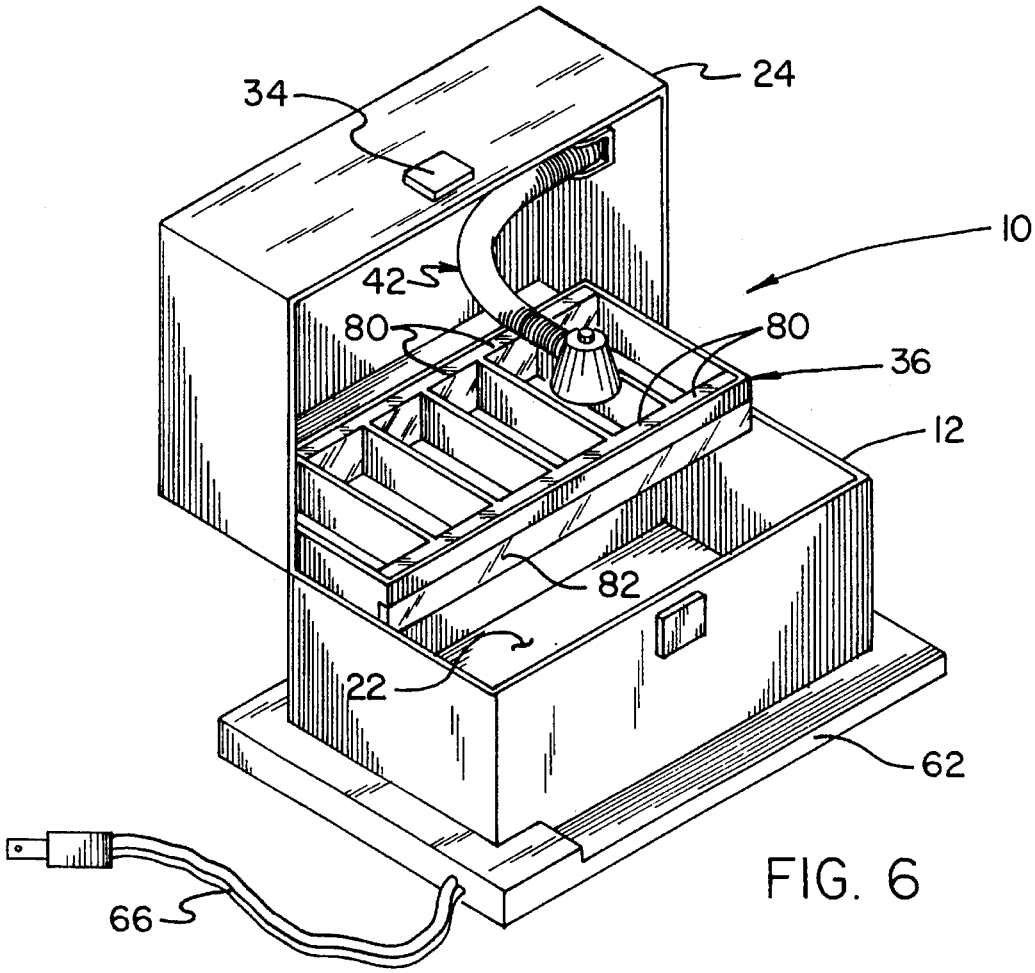
FIG. 6 is an isometric illustration of the invention including compartment lights and a main body interior light.
Figure 7:
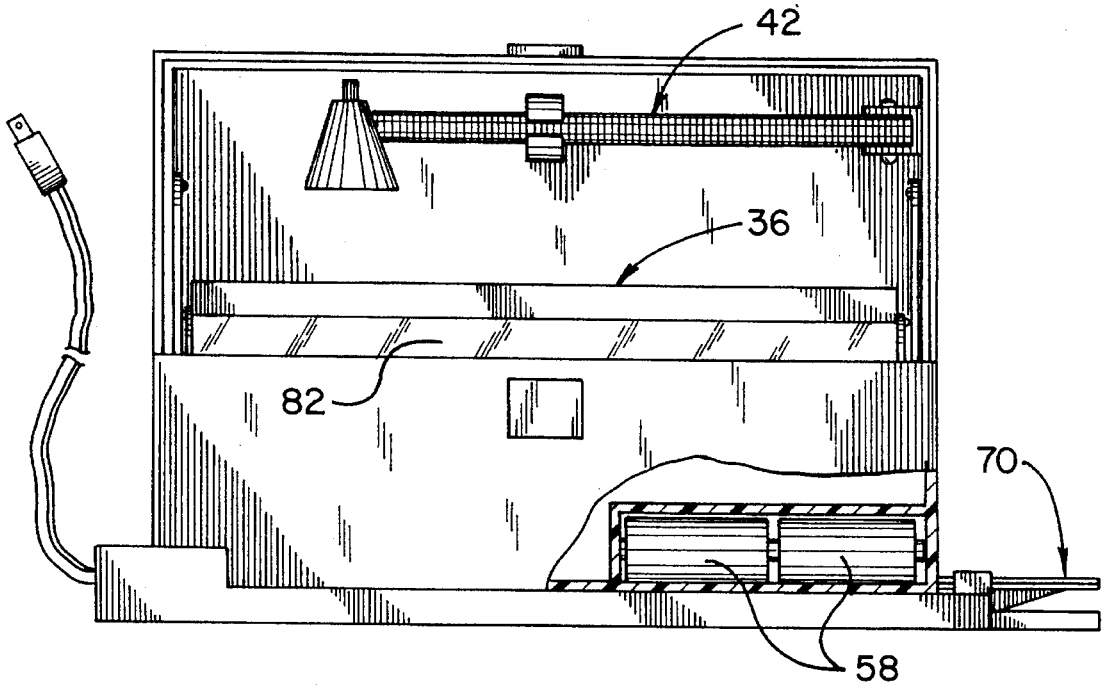
FIG. 7 is a front elevation view of the invention illustrated in FIG. 6.

Referring now to FIGS. 6 and 7 of the drawings, it can be shown that the tray 36 may include a plurality of compartment lights 80 which cooperate to illuminate each of the compartments 38. Further, the tray 36 may also include a main body interior light 82 which illuminates the main body interior 22. The compartment lights 80, as well as the main body interior light 82, are in selective electrical communication with the batteries 58 through a plurality of unlabeled wires which provide such communication. Although not specifically illustrated, either a manual or an automatic switch means should be provided to effect either selective manual operation, or automatic energization of the compartment lights 80 and the main body interior light 82 upon opening of the lid 24.

Figure 8:
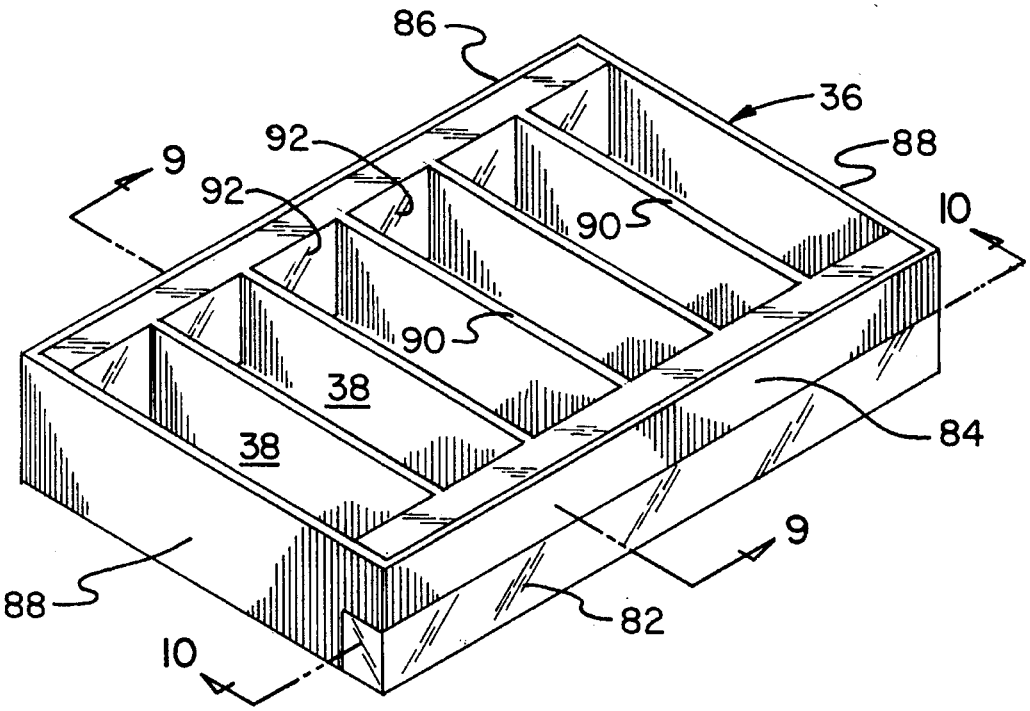
FIG. 8 is an enlarged isometric illustration of a tray comprising a portion of the present invention.
Figure 9:
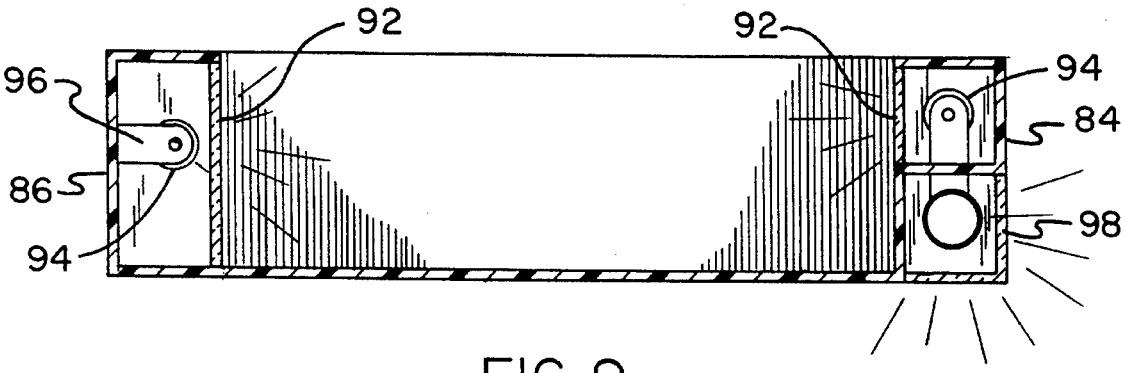
FIG. 9 is a cross-sectional view taken along line 9—9 of FIG. 8.
Figure 10:
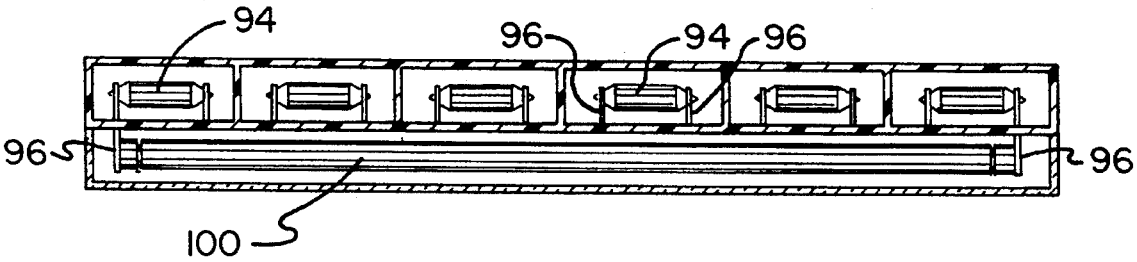
FIG. 10 is a further cross-sectional view taken along line 10—10 of FIG. 8.

The tray 36 is illustrated in detail in FIGS. 8–10, and it can be shown from these figures that the tray comprises a front wall 84 spaced from a rear wall 86, as well as a pair of opposed tray sidewalls 88. The tray 36 is divided into the plurality of compartments 38 by a plurality of partitions 90 which preferably extend between the front and rear walls 84, 86. Each of the compartments 38 includes a pair of compartment lenses 92 which orthogonally extend between the partitions 90 proximal to, but spaced from, the front and rear walls 84, 86. Positioned behind each of the lenses 92 is a light bulb 94 which communicates with the batteries 58 through a plurality of contacts.96, whereby the light bulbs 94 can be energized by the batteries.

With continuing reference to FIGS. 8–10, it can be shown that the main body interior light 82 comprises an elongated lens 98 which forms a portion of the front wall 84 of the tray 36. Positioned behind the elongated lens 98 is an elongated light bulb ]00 which communicates with the batteries 58 through similar contacts 96. The elongated light bulb 100 may comprise an incandescent light bulb, but preferably comprises a fluorescent light bulb. The main body interior light 82 effectively illuminates the main body interior 22 when the lid 24 is in the open position illustrated in FIG. 6.

Figure 11:
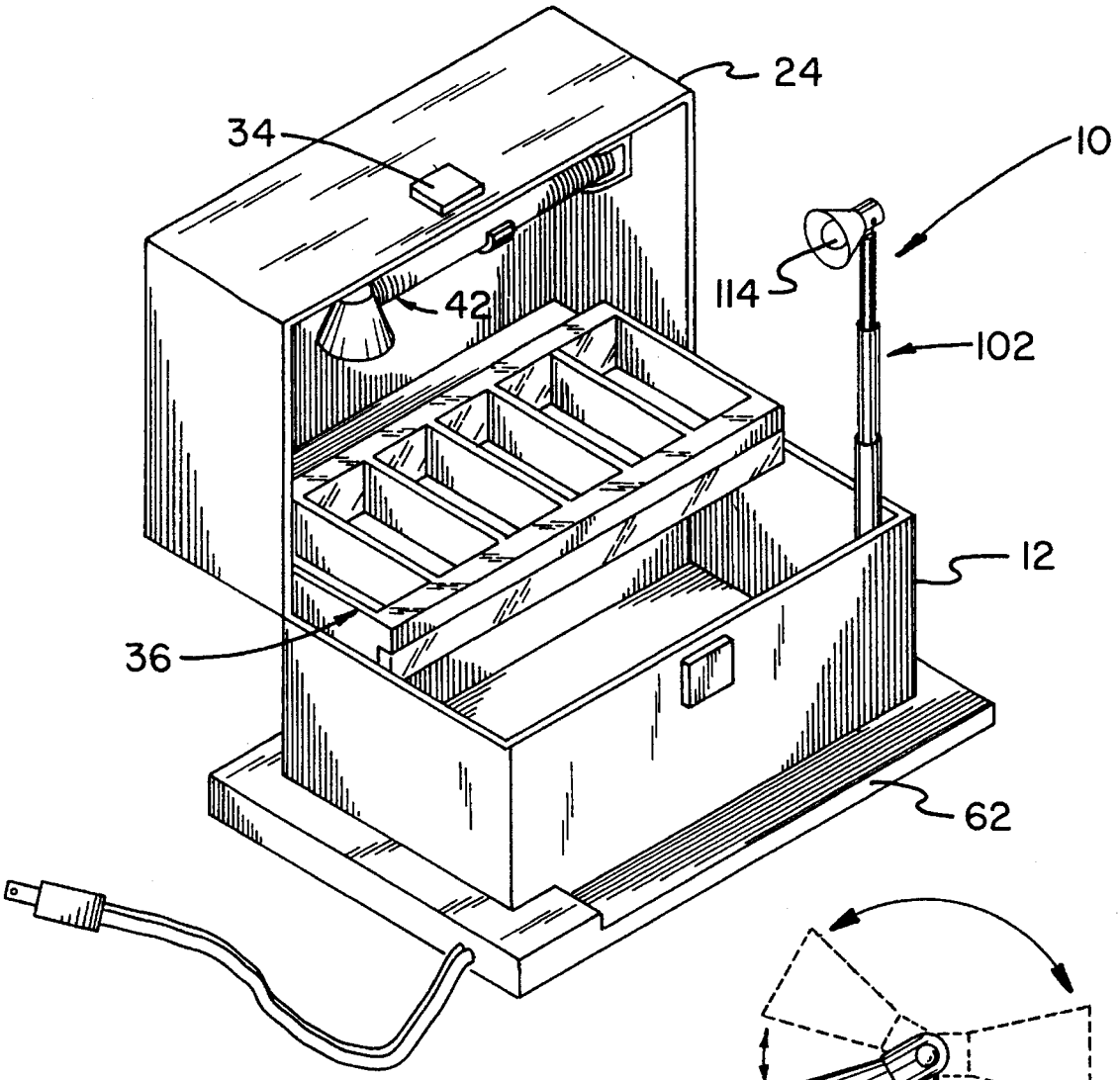
FIG. 11 is an isometric illustration of the invention including a telescoping light.
Figure 12:
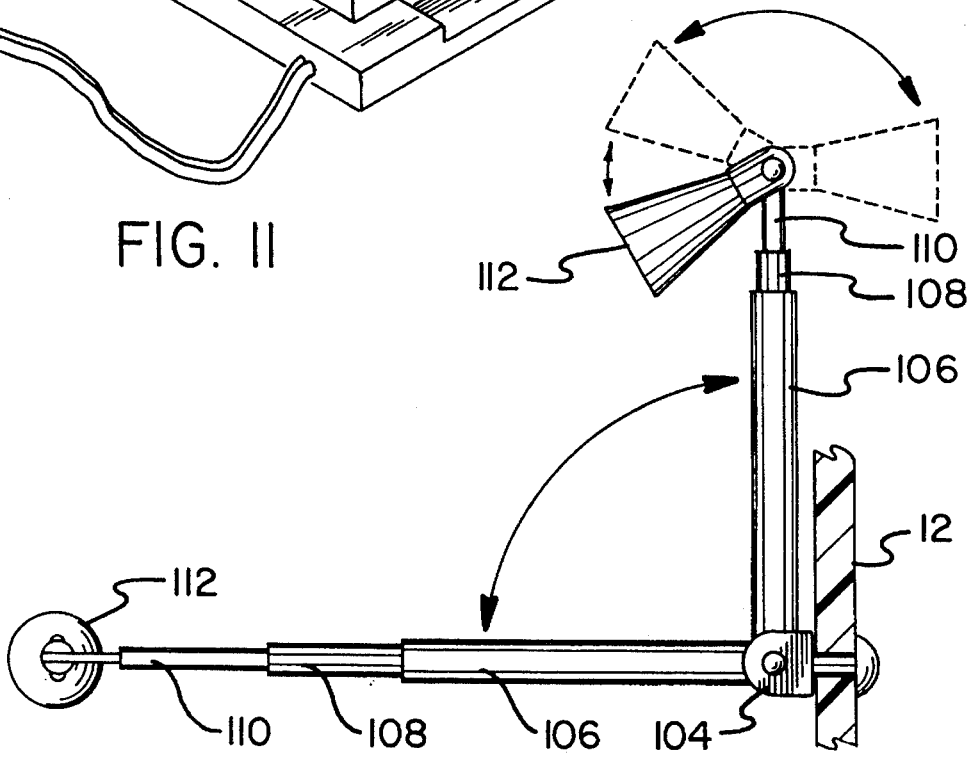
FIG. 12 is a front elevation view of the telescoping light.

FIGS. 11 and 12 illustrate the addition of a telescoping light 102 to the illuminated utility box 10. To this end, the telescoping light 102 comprises a telescoping light bracket 104 pivotally mounted to a portion of the main body 12. A first member 106 of preferably tubular shape is pivotally mounted to the telescoping light bracket 104 and receives a second member 108 therewithin. The bracket 104 is mounted to main body 12. Similarly, the second member 108 receives a third member 110 therewithin, whereby the second and third members may be extended in a telescoping manner, with frictional engagement between the members 106–110 operating to retain the members in a desired position. A shade 112 is pivotally mounted to an outer distal end of the third member 110 and mounts a light bulb 114 therewithin. The light bulb 114 is in selective electrical communication with the batteries 58 by an unillustrated switch means which is either manually or automatically operated in a manner similar to that of the compartment lights 80 and the main body interior light 82.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact .construction and operation shown and described, and accordingly, all suitable modifications and equivalents may be resorted to, falling within the scope of the invention.

What is claimed as being new and desired to be protected by Letters Patent of the United States is as follows:

1. An illuminated utility box comprising:

a main body having a bottom wall, a front wall spaced from a rear wall, and a pair of opposed sidewalls which project orthogonally from said bottom wall to define a main body interior within said main body;

a lid pivotally mounted to said rear wall of said main body, said lid including a lid front wall spaced from a lid rear wall and a pair of opposed lid sidewalls which project from a lid top wall;

a lid light pivotally mounted to an interior of said lid, wherein said lid light comprises a bracket mounted to said sidewall of said lid with a length of flexible tubing having an inner and outer distal end, said inner distal end pivotally mounted to said bracket; a bulb receptacle interconnected to said outer distal end of said flexible tubing;

a light bulb engaged to said bulb receptacle;

a switch coupled to said bulb receptacle and operable to effect selective energization of said light bulb;

a shade extending around and mounted to said bulb receptacle; and a tray having a plurality of compartments, said tray being pivotally mounted to said lid by a plurality of levers which cooperate to maintain said tray in a substantially horizontal position during opening and closing of said lid relative to said main body, said tray comprises a plurality of compartment lights, each of said lights separately illuminates each of said compartments, and said tray further comprises a main body interior light which mainly illuminates said main body interior.

* * * * *